US006771229B2

(12) United States Patent
Thornburgh

(10) Patent No.: US 6,771,229 B2
(45) Date of Patent: Aug. 3, 2004

(54) INFLATABLE REFLECTOR

(75) Inventor: Robert P. Thornburgh, Newport News, VA (US)

(73) Assignee: Honeywell International Inc., Morristown, NJ (US)

( * ) Notice: Subject to any disclaimer, the term of this patent is extended or adjusted under 35 U.S.C. 154(b) by 41 days.

(21) Appl. No.: 10/271,202

(22) Filed: Oct. 15, 2002

(65) Prior Publication Data

US 2004/0070549 A1 Apr. 15, 2004

(51) Int. Cl.[7] ..... H01Q 15/02; H01Q 15/00

(52) U.S. Cl. ..... 343/915; 343/912; 342/8; 342/10

(58) Field of Search ..... 343/709, 912, 343/915; 342/6, 8, 10

(56) References Cited

U.S. PATENT DOCUMENTS

| | | | | | |
|---|---|---|---|---|---|
| 3,005,987 | A | * | 10/1961 | Mack et al. | 343/872 |
| 3,326,624 | A | * | 6/1967 | Maydell et al. | 343/915 |
| 5,202,689 | A | * | 4/1993 | Bussard et al. | 342/10 |
| 5,920,294 | A | * | 7/1999 | Allen | 343/912 |
| 5,990,851 | A | * | 11/1999 | Henderson et al. | 343/915 |
| 6,219,009 | B1 | * | 4/2001 | Shipley et al. | 343/915 |
| 6,388,637 | B1 | * | 5/2002 | Davis | 343/915 |
| 6,417,818 | B2 | * | 7/2002 | Shipley et al. | 343/915 |

OTHER PUBLICATIONS

Baier, H., Datashvili, L., Gogava, Z., Medzmariashvili, E., and Montuori, V., "Building Blocks of Advanced Large Stowable Precision Membrane Reflectors," Proceedings of the European Conference on Spacecraft Structures, Materials and Mechanical Testing, Noordwijk, The Netherlands, Nov. 29–Dec. 1, 2000, pp. 99–105.

Chmielewski, A., "Arise Antenna," Presented at the Ultra Lightweight Space Optics Challenge Workshop, Napa, CA, Mar. 24–25, 1999, 10 pages.

DeBlonk, B., Miller, D., "Narrowing the Design Space of a Large Membrane Mirror," Presented at the Ultra Lightweight Space Optics Challenge Workshop, Napa, CA, Mar. 24–25, 1999, 8 pages.

Freeland, R., Bilyeu, G., Veal, G., Mikulas, M., "Inflatable Deployable Space Structures Technology Summary," Presented at the 49$^{th}$ Congress of the International Astronautical Federation, Melbourne, Australia, Sep. 28–Oct. 2, 1998, Paris, France. IAF Paper 1.5.01, 16 pages.

Palisoc, A., Veal, G., Cassapakis, C., Greschik, G., Mikulas, M., "Geometry Attained by Pressurized Membranes," Proceedings of the SPIE (The International Society for Optical Engineering), Space Telescopes and Instruments V, Eds.: Bely, Pierre Y.; Breckinridge, James B. , vol. 3356, pp.747–757, Published: Aug. 1998.

Zeiders, G., "Innovative Design Concepts For Ultralightweight Space Telescopes," Presented at the Ultra Lightweight Space Optics Challenge Workshop, Napa, CA, Mar. 24–25, 1999, 7 pages.

"Trw Ships Astromesh Reflector Antenna to Hughes," SpaceDaily.com, published Jun. 29, 2000, 2 pages.

"Sea Launch Vessels Depart to Loft Thuraya Satellite," *Spaceflight Now Mission Report*, posted Oct. 10, 2000, 2 pages.

* cited by examiner

*Primary Examiner*—Tan Ho

(57) ABSTRACT

An inflatable antenna has a plurality of inflatable tori including a first toroidal member and a second toroidal member arranged one radially inward of the other. A front membrane having a reflective coating is attached to the plurality of tori to form a front reflective surface. A rear membrane is attached to the plurality of tori and provides a rear support surface. The inflatable reflector is lightweight and compact and can be easily inflated to a desired shape.

20 Claims, 2 Drawing Sheets

INFLATABLE REFLECTOR

BACKGROUND OF THE INVENTION

The present invention generally relates to reflectors and, more particularly, relates to concave inflatable reflectors for reflecting electromagnetic signals.

Satellite spacecraft often employ large telescopes and antennas that require large concave reflectors for reflecting electromagnetic signals, such as light, infrared (IR) and radio frequency (RF) signals. Reflectors employed on spacecraft generally must be lightweight and compactly storable in a small volume for transportation into space, and then deployable into a desired shape when in orbit. Deployable reflectors exist which include inflatable reflectors and wire frame supported reflectors. Conventional inflatable reflectors typically use the pressure of a gas to fill and, thus, deform a circular membrane having a reflective surface into a desired shape. The pressurized gas is injected into an optically transparent membrane that is deformed into the deployed shape. The transparent membrane generally includes an inner reflective surface that provides the reflectivity. Tension is typically applied radially to the membrane by a rigid ring formed around the circumference of the reflector. The ring is often in the form of a single inflatable toroid. The inflatable membrane reflector typically utilizes an inflatable tube and struts to move the inflatable membrane into position.

Conventional inflatable reflectors exhibit several drawbacks. The electromagnetic signals (e.g., light signals) that are reflected by the inner reflective surface are required to pass through the transparent membrane and the pressurized gas at least twice before reaching a focal optical instrument. The transparent membrane and inflating gas may adversely affect the signals and may cause minute distortions in the optical wavelength of the signals. Additionally, conventional inflatable reflectors are generally sensitive to thermal and vibrational disturbances resulting from very low stiffness of the resultant structure.

Another deployable reflector structure employs a reflective membrane on the rear side of a support structure to create a biconcave reflector. The biconcave reflector has a membrane that exerts a force on the reflective membrane to pull the reflector into a desired shape. This force can either be accomplished mechanically by using springs or by applying a non-contact force produced by a magnetic or electrostatic field. A surrounding inflatable ring may further provide tension to the resultant structure. This biconcave reflector technique eliminates the transparent membrane through which signals would have to pass, however, there exists difficulty in the application of force to the reflector to achieve the desired shape. Further, springs that are used to form the resultant structure create point-like loads and, thus, form dimples on the reflective surface, which can distort the electromagnetic signals. The use of a magnetic or electrostatic field to produce the force can be difficult to create and effectively control.

It is therefore desirable to provide for a deployable reflector for reflecting electromagnetic signals in a lightweight and compact structure that may be easily deployed to a desired shape. It is further desirable to provide for an inflatable reflector that may be easily used for spacecraft applications, and which does not suffer from disadvantages of conventional deployable reflectors.

SUMMARY OF THE INVENTION

The present invention provides for an inflatable reflector that is lightweight and compact and can be easily inflated to a desired shape. The inflatable antenna has a plurality of inflatable tori including a first inflatable toroidal member and a second inflatable toroidal member arranged one radially inward of the other. A front membrane is attached to a front side of the plurality of inflatable tori to form a reflective surface, and a rear support membrane is attached to a rear side of the inflatable tori and provides a rear support structure. The reflector is compact and lightweight and the plurality of inflatable tori are inflated by a pressurized gas to deploy the reflector into a desired shape.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
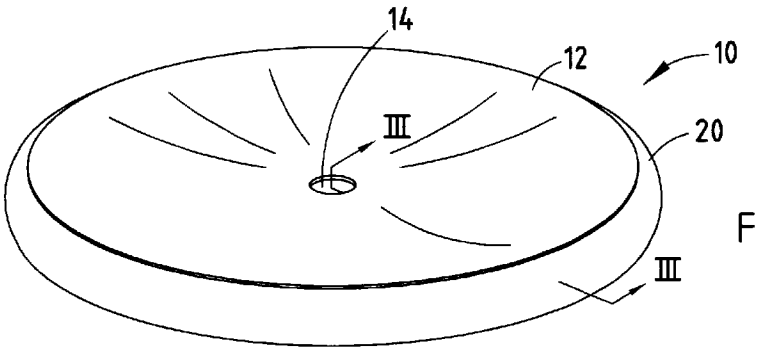
FIG. 1 is a perspective view of a double-concave inflatable reflector according to the present invention.
Figure 3:
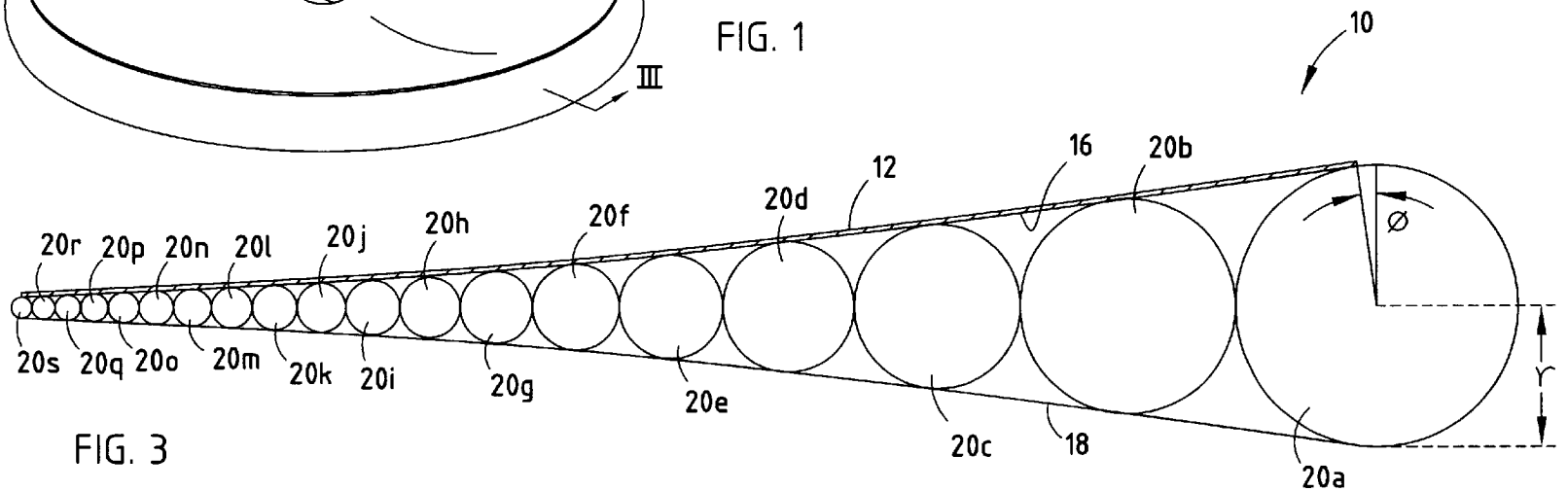
FIG. 3 is an enlarged cross-sectional view of the inflatable reflector taken through lines III—III of FIG. 1.
Figure 2:
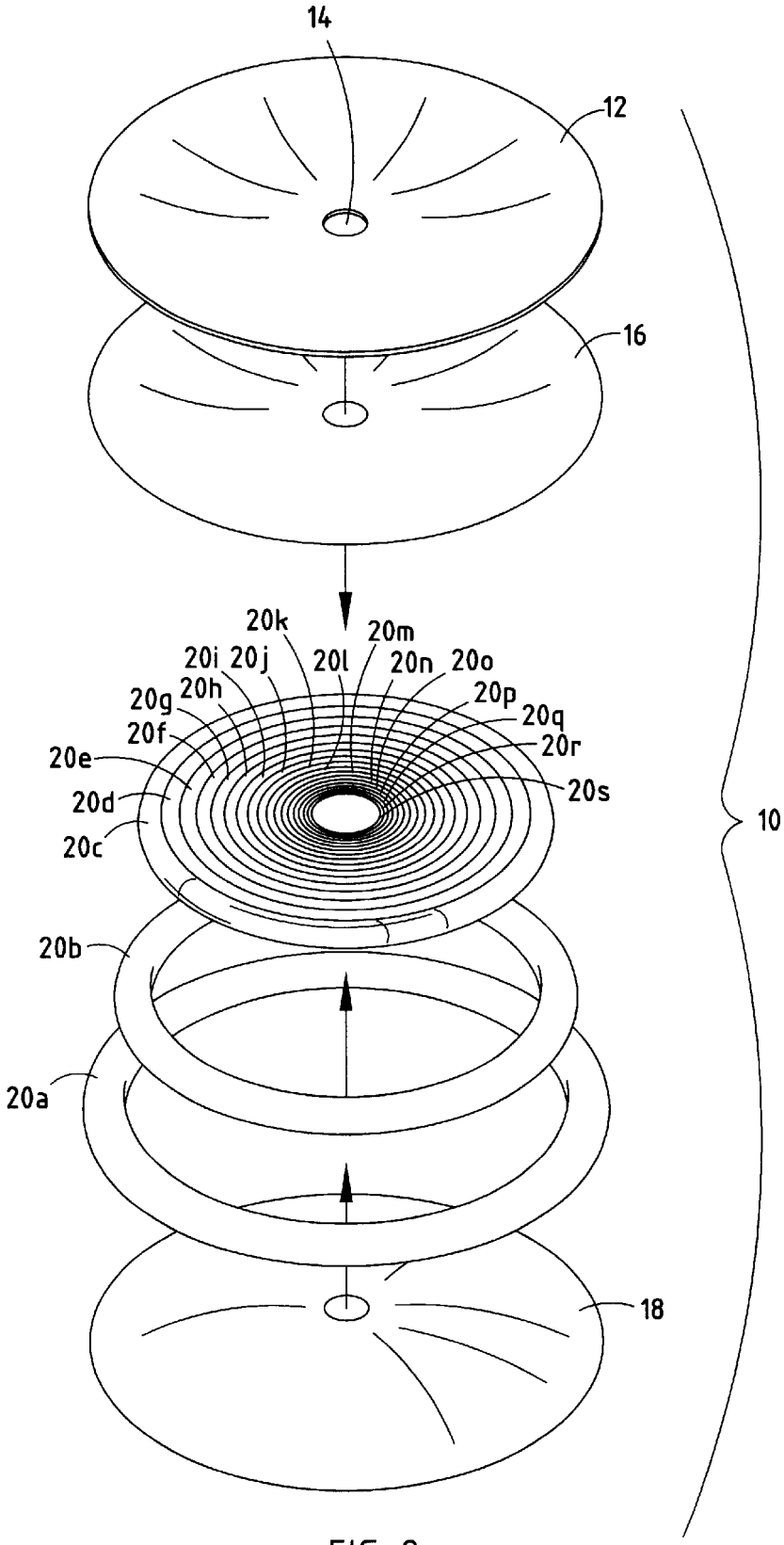
FIG. 2 is an exploded view of the inflatable reflector shown in FIG. 1.

Referring to FIGS. 1–3, an inflatable reflector 10 is illustrated in the inflated (deployed) position having a generally double-concave configuration. The inflatable reflector 10 has a front reflective surface 12 formed into a concave shape for reflecting electromagnetic signals, such as light, infrared (IR), radio frequency (RF) signals, and other signals of a desired frequency. The rear surface 18 of the reflector 10 is also formed into a generally concave shape. The inflatable reflector 10 may be used in connection with a telescope, antenna, and other signal transmission and/or reception devices to reflect electromagnetic signals, and is particularly well-suited for use on a spacecraft, such as a satellite.

The inflatable antenna 10 includes a plurality of inflatable tori (toroidal members) 20*a*–20*s* having different cross-sectional radii (r) and arranged sequentially one disposed radially inward of another so as to define a semi-rigid supporting structure for shaping the front reflective concave surface and the rear concave surface. Each of the inflatable tori 20*a*–20*s* is made of a thin flexible gas non-permeable membrane configured to form a toroidal shape (i.e., donut shape) when fully inflated with pressurized gas. The membrane forming each of inflatable tori 20*a*–20*s* may include a space certified material, such as polyimide. The innermost inflatable toroidal member 20*s* is shown having the smallest cross-sectional radius r, while each radially outward disposed tori 20*r*–20*a* has an increasing cross-sectional radius r configured to form the shape of the concave front surface and the supportive concave rear surface. Adjacent inflatable tori 20*a*–20*s* may be bonded together via adhesive or welded together at select locations along an adjoining strip, to hold the adjacent inflatable tori 20*a*–20*s* together and maintain the parabolic concave front face.

The front surface of inflatable reflector 10 is formed of a thin flexible membrane 16 attached to the front surface of each of the plurality of inflatable tori 20*a*–20*s*. The front membrane 16 may be made of a flexible space certified material including a polymer, such as polyimide. The front membrane 16 is attached to the front side of each of toroidal members 20*a*–20*s* at a location shown by angle θ where the first membrane 16 is tangent to the corresponding toroidal member. Formed over the front membrane 16 is a metallic reflective coating 12 which serves to reflect electromagnetic signals. The metallic reflective coating 12 may include any of a number of coating materials, such as a gold or aluminum, exhibiting sufficient reflectivity to reflect desired electromagnetic signals. The reflective coating 12 may be formed on top of front membrane 16 by electrodeposition or other known coating techniques. Alternately, the front membrane 16 and reflective coating 12 may be replaced by a reflective material, thus eliminating the need for a separate membrane 16.

Attached to the rear side of each of the inflatable tori 20*a*–20*s* is a rear membrane 18. The rear membrane 18 may be made of a flexible space certified material including a polymer, such as polyimide. Rear membrane 18 is forced under tension when the inflatable tori 20*a*–20*s* are fully inflated to provide structural support to maintain the inflatable reflector 10 in a double-concave configuration such that the front and rear surfaces are both concave. That is, the reflector 12 has a front concave surface facing forward formed by front membrane 16 and reflective coating 12, and further has a rear concave surface facing rearward formed by rear membrane 18. The rear membrane 18 may include one or more members that support the inflated reflector 10 in the desired configuration.

The front and rear membranes 16 and 18, respectively, are attached to each of the plurality of inflatable tori 20*a*–20*s* by a known technique which include the use of adhesive bonding or thermal welding. The front and rear membranes 16 and 18 are preferably forced under tension into a fully deployed shape of the double-concave configuration when each of the inflatable tori 20*a*–20*s* are fully inflated with pressurized gas so as to form a semi-rigid structure. It should be appreciated that the inflatable tori 20*a*–20*s* may be deflated by expelling the gas from within tori 20*a*–20*s* such that the reflector 10 can be folded into a compact structure that consumes a very small volume when not in use. Upon reinflation, the reflector 12 will expand when pressurized gas is injected into inflatable tori 20*a*–20*s* to form the semi-rigid double concave structure.

The plurality of inflatable tori 20*a*–20*s* may be individually inflated by releasing pressurized gas from one or more gas sources into individual inlet valves associated with each corresponding inflatable tori 20*a*–20*s*, or may be commonly inflated into all or some of the inflatable tori 20*a*–20*s* via a common gas inlet passage. The pressurized gas may include any of a number of known pressurizable gases, such as nitrogen and helium, which provide adequate rigidity to each of the toroidal members 20*a*–20*s*. It should be further be appreciated that the source of pressurized gas may be controlled to maintain the rigidity of the plurality of inflatable tori 20*a*–20*s* so as to compensate for the coefficient of thermal expansion of the inflating gas during temperature variations and due to other causes.

Also shown formed centrally in the inflatable reflector 10 is an opening 14. The presence of an opening 14 may allow for electromagnetic signal transmission and/or reception devices to be employed therein in a multiple reflector signal transmission and/or reception system. However, it should be appreciated that the inflatable reflector 10 may be provided with or without central opening 14. Absent the opening 14, front membrane 16 and reflective coating 12 may extend over the central portion of the reflector 10.

The size of each of the plurality of inflatable tori 20*a*–20*s* may vary depending upon the overall shape and size of the inflatable reflector 10. It should be appreciated that by employing multiple inflatable tori 20*a*–20*s* having different size cross-sectional radii (r), a different contoured shape of the reflector 10 may be achieved, as should be evident to those in the art. It should further be appreciated that a shaped reflector configuration may be achieved by specially shaping some or all of the individual inflatable tori 20*a*–20*s*, without departing from the teachings of the present invention.

Figure 4:
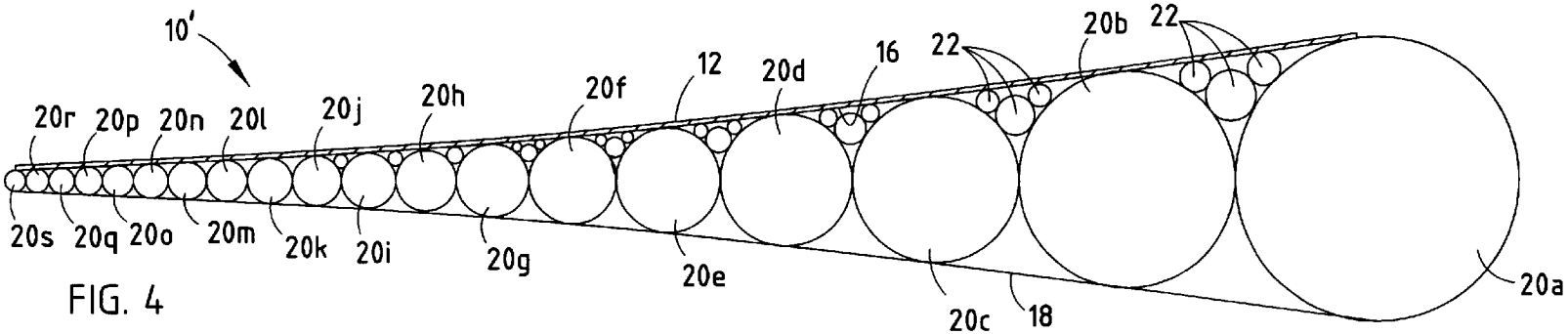
FIG. 4 is a cross-sectional view of the inflatable reflector further including additional inflatable tori according to another embodiment of the present invention.

Referring to FIG. 4, a cross-sectional view of an inflatable reflector 10' is shown configured similar to reflector 10, with the exception that a plurality of additional inflatable tori 22 are disposed between adjacent tori 20*a*–20*s* and front surface membrane 16. The additional inflatable tori 22 are positioned such as to fill the open void region and further support and shape the underside of front membrane 16 to better define the front concave contour by filling the void region so as to reduce faceting and errors that may otherwise be present in the overall concave reflector surface. The number, size, and shape of each of the additional inflatable tori 20 may vary. It should also be appreciated that an additional outer perimeter inflatable tori (not shown) may also be connected to the outer perimeter of tori 20*a* to provide added support around the perimeter of the reflector 10 or 10'.

Accordingly, the inflatable reflector 10 or 10' of the present invention advantageously provides for a compact and easy to deploy deployable inflatable reflector that is particularly well-suited for use on satellite and other spacecraft. The inflatable reflector 10 may be stored in a compact volume for storage during transportation and may easily be deployed to a fully inflated volume during deployment in space. The additional inflatable tori 22, similar to inflatable tori 20*a*–20*s*, may be individually inflated by releasing pressurized gas from one or more gas sources into individual inlet valves, or may be commonly inflated together via a common gas inlet passage.

While the inflatable antenna 10 or 10' has been described in connection with an antenna that may be inflated and deflated, it should be appreciated that antenna 10 or 10' may alternately employ inflatable tori 20*a*–20*s*, and also inflatable tori 22, that use a soft curable membrane that cures when inflated with gas so as to rigidify upon inflation into a semi-rigid structure. Once the soft membrane cures, the inflatable tori do not need to maintain pressurized gas within the structure as the structure itself becomes semi-rigid. Thus, such an alternate structure may not be readily deflated simply by expelling pressurized gas from within the structure.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. An inflatable reflector comprising:

a plurality of inflatable tori including a first inflatable toroidal member and a second inflatable toroidal member disposed radially inward of the first inflatable toroidal member;

a front membrane attached to a front side of the plurality of inflatable tori and forming a front reflective surface; and a rear support membrane attached to a rear side of the plurality of tori and forming a rear support structure.

2. The reflector as defined in claim 1, wherein the first membrane includes a polymer membrane having a metallic reflective coating formed therein.

3. The reflector as defined in claim 1, wherein the front reflective surface forms a concave reflective surface for reflecting electromagnetic signals.

4. The reflector as defined in claim 1, wherein the front membrane and the rear support membrane form first and second concave surfaces.

5. The reflector as defined in claim 1, wherein the first inflatable toroidal member has a first radius, and a second inflatable toroidal member has a second radius, wherein the first radius is greater than the second radius.

6. The reflector as defined in claim 5, wherein the plurality of inflatable tori further comprises a third toroidal member disposed radially inward of the second inflatable toroidal member and having a third radius less than the second radius.

7. The reflector as defined claim 1 further comprising a third inflatable toroidal member disposed between the first and second inflatable toroidal members and the front membrane.

8. The reflector as defined in claim 1, wherein the plurality of inflatable tori each comprises a polyimide material.

9. An inflatable reflector comprising:

a first inflatable toroidal member having a first radius;

a second inflatable toroidal member disposed radially inward of the first toroidal member, wherein the second inflatable toroidal member has a second radius less than the first radius;

a front reflective surface attached to a first side of the first and second toroidal members for forming a concave reflective surface for reflecting electromagnetic signals; and a rear membrane attached to a rear surface of the first and second inflatable toroidal members for supporting the first and second inflatable toroidal members to maintain the concave reflective surface.

10. The reflector as defined in claim 9 further comprising a third inflatable toroidal member disposed radially inward of the second inflatable toroidal member and having a third radius less than the second radius.

11. The reflector as defined in claim 9, wherein the front reflective surface comprises a membrane attached to the first and second inflatable toroidal members and a metallic reflective coating formed on top of the first membrane.

12. The reflector as defined in claim 9 further comprising a third inflatable toroidal member disposed in a volume formed between the first and second inflatable toroidal members and the front reflective surface.

13. The reflector as defined in claim 9, wherein the front reflective surface and the rear surface form first and second concave surfaces.

14. The reflector as defined in claim 9, wherein each of the plurality of inflatable tori comprises a polyimide material.

15. A method of forming an inflatable antenna comprising the steps of:

providing a first inflatable toroidal member having a first radius;

providing a second inflatable toroidal member having a second radius, wherein the second radius is less than the first radius;

disposing the second inflatable toroidal member radially inward and adjacent to the first inflatable toroidal member;

attaching a reflective surface to a front side of the first and second inflatable toroidal members;

attaching a supporting membrane to a rear side of the first and second inflatable toroidal members; and inflating the first and second inflatable toroidal members with a gas to form a reflector having a concave reflective surface for reflecting electromagnetic signals.

16. The method as defined in claim 15 further comprising a third inflatable toroidal member disposed radially inward of the second inflatable toroidal member and having a third radius less than the second radius.

17. The method as defined in claim 15 further comprising the step of attaching the first and second inflatable toroidal members to each other.

18. The method as defined in claim 15 further comprising the steps of:

providing a third toroidal member disposed in a volume between the first and second inflatable toroidal members and the front reflective surface; and inflating the third inflatable toroidal member with a gas to further support the front reflective surface.

19. The method as defined in claim 15, wherein the step of attaching a reflective surface comprises forming a reflective coating on a front membrane and attaching the front membrane to the front side of the first and second inflatable toroidal members.

20. The method as defined in claim 15 further comprising the step of deploying the reflector on a spacecraft.

* * * * *